US010854117B2

(12) United States Patent
Daly

(10) Patent No.: US 10,854,117 B2
(45) Date of Patent: Dec. 1, 2020

(54) FASTENING DEVICE

(71) Applicant: ID&C LIMITED, Kent (GB)

(72) Inventor: Stephen Daly, Kent (GB)

(73) Assignee: ID&C LIMITED

( * ) Notice: Subject to any disclaimer, the term of this patent is extended or adjusted under 35 U.S.C. 154(b) by 885 days.

(21) Appl. No.: 14/905,321

(22) PCT Filed: Jul. 16, 2014

(86) PCT No.: PCT/GB2014/052166
§ 371 (c)(1),
(2) Date: Jan. 15, 2016

(87) PCT Pub. No.: WO2015/008060
PCT Pub. Date: Jan. 22, 2015

(65) Prior Publication Data

US 2016/0284249 A1 Sep. 29, 2016

(30) Foreign Application Priority Data

Jul. 16, 2013 (GB) ..... 1312685.9

(51) Int. Cl.
*G09F 3/16* (2006.01)
*G09F 3/00* (2006.01)
*G09F 3/03* (2006.01)

(52) U.S. Cl.
CPC ..... *G09F 3/16* (2013.01); *G09F 3/005* (2013.01); *G09F 3/0323* (2013.01); *G09F 3/0335* (2013.01)

(58) Field of Classification Search
CPC ..... Y10T 292/087; Y10T 292/0874; Y10T 292/205; Y10T 292/212; Y10T 292/40; Y10T 292/48; Y10T 292/49; Y10T 292/491; Y10T 292/494; Y10T 292/50; Y10T 292/502; Y10T 292/505;
(Continued)

(56) References Cited

U.S. PATENT DOCUMENTS 3,034,189 A * 5/1962 Twentier ..... A44C 5/18 24/129 R
3,983,604 A * 10/1976 Phillips ..... B65D 63/08 24/16 PB (Continued)

FOREIGN PATENT DOCUMENTS

CN 202006937 10/2011
JP 2007/148066 6/2007

(Continued)

OTHER PUBLICATIONS

PCT: Notification Concerning Transmittal of International Preliminary Report on Patentability and attachments, dated Jan. 28, 2016, pp. 1-11.

*Primary Examiner* — Alyson M Merlino
(74) *Attorney, Agent, or Firm* — McDonald Hopkins LLC

(57) ABSTRACT

A tamper-evident fastening device suitable for use with a wristband. The device may include a casing with two separate portions and a divider that defines two substantially parallel paths of a strap and is adapted to retain two portions of a strap. The two separate portions may be positioned on each planar surface of the divider. The divider and the casing may be configured such that they are capable of being connected together via an irreversible lock.

21 Claims, 6 Drawing Sheets

(58) Field of Classification Search
CPC ..... Y10T 292/506; Y10T 292/507; Y10T 292/509; Y10T 292/51; Y10T 292/528; Y10T 292/534; Y10T 292/513; Y10T 24/44274; Y10T 24/492; Y10T 24/497; G09F 3/16; G09F 3/005; G09F 3/0323; G09F 3/0335; G09F 3/03; G09F 3/00; G09F 3/0276; G09F 3/0277; G09F 3/0311; G09F 3/0341
See application file for complete search history.

(56) References Cited

U.S. PATENT DOCUMENTS 4,600,220 A * 7/1986 Agnelli ..... F16B 41/007 292/307 B
4,782,977 A * 11/1988 Watanabe ..... B65D 55/024 292/307 R
4,882,813 A 11/1989 Nakamura
5,208,950 A * 5/1993 Merritt ..... F16G 11/14 24/115 H
5,566,427 A * 10/1996 Lathrop ..... A44B 11/06 24/169
5,671,508 A * 9/1997 Murai ..... F16G 11/101 24/115 K
5,979,691 A * 11/1999 Von Holdt ..... B65D 43/0256 220/266
6,044,527 A * 4/2000 Ishida ..... F16G 11/101 24/115 F
6,128,809 A * 10/2000 Khokhar ..... F16L 3/2338 24/136 R
6,253,952 B1 * 7/2001 Vial B. ..... B65D 1/22 220/324
6,318,585 B1 * 11/2001 Asagiri ..... B60R 22/34 220/326
6,328,355 B1 * 12/2001 Bortz ..... G09F 3/0323 292/307 R
6,453,519 B1 * 9/2002 Gelardi ..... A44B 11/06 24/16 PB
6,684,462 B1 2/2004 Narula et al.
2003/0066169 A1 4/2003 Liu
2004/0231110 A1 11/2004 Hutter, III
2006/0087431 A1 4/2006 Shieh et al.
2011/0061212 A1 * 3/2011 Piermayr ..... G09F 3/005 24/265 R
2012/0084948 A1 * 4/2012 Breen, IV ..... B65D 63/1063 24/16 R
2013/0205545 A1 * 8/2013 Zantout ..... B65D 63/00 24/16 R

FOREIGN PATENT DOCUMENTS

WO WO-2011145941 A1 * 11/2011 ..... G09F 3/005
WO 2012/51114 4/2012
WO 2013/095100 A1 6/2013

* cited by examiner

FASTENING DEVICE

The present invention relates to a fastening device and particularly to a fastening device adapted for use with a wristband.

BACKGROUND OF INVENTION

Identification bands are commonly used in many applications. For example: collars may be used to identify pets in a veterinary surgery; and wristbands are used for the identification of human patients (particularly new born babies) in hospitals. In the latter case, the band is appropriately positioned and fixed around the patient's wrist as early as possible after arrival at a hospital. Such bands are commonly fastened by a strong adhesive or by a non-releasable stud. This is intended to ensure that the band cannot be easily removed and replaced without providing clear evidence of tampering and that the band cannot be re-used. It is usually necessary to cut the band in order to remove it from the patient when it is no longer required.

More recently, wristbands have been used in the entertainment industry, particularly at large concerts or sporting events. For example, wristbands may be used to implement non-transferable ticketing, to assist in crowd control, to identify advance payers, to control access to VIP areas and to eliminate lost tickets.

The use of wristbands for these purposes relies on them being difficult to reproduce and difficult to remove without visible damage. It is also preferable that the wristbands be highly visible and made to a variety of designs, all or which are easy to put on.

Traditionally, plastic bands formed from a sheet of a plastics material have been used for such purposes. Details are printed on the plastic or placed on inserts sealed in pockets formed in the plastic sheet. However, modern printer technology is now widely available and enables fraudsters to quickly copy such bands. In addition, certain types of plastic sheet material can be warmed and manipulated to facilitate removal of the band without apparent damage, thereby facilitating undetected transfer of the band to another individual.

An alternative to a plastic band is a woven fabric band with an intricate pattern woven or sewn into it using threads of many different colours. Such bands are much more difficult to copy using commonly available technology and do not generally become more pliable on heating. Accordingly, a fabric wristband with a novel and detailed woven design provides a suitable band for use by the entertainment industry.

Such bands may be fastened using a compressible metal ring through which the band is threaded. In order to fasten the band, an official compresses the ring using a pair of plier-type hand or bench crushers.

SUMMARY OF INVENTION

In a first aspect of the invention, there is provided a tamper-evident fastening device suitable for use with a wristband, wherein the device comprises: a casing comprising two separate portions; and a divider which defines two substantially parallel paths of a strap and is adapted to retain two portions of a strap, wherein the two separate portions are positioned on each planar surface of the divider, and wherein the divider and the casing are configured such that they are capable of being connected together via an irreversible lock.

In a second aspect of the invention, there is provided a fastening device suitable for use with a strap, said device comprising: a casing; a divider disposed within the casing, wherein two substantially parallel paths for receiving first and second end portions of a strap are defined between the divider and the casing; and first and second retaining members arranged on opposite sides of the divider, wherein the first retaining member is arranged to hold a first end portion of the strap so that longitudinal movement of the first end portion is inhibited, and wherein the second retaining member is arranged to hold a second end portion of the strap such that movement of the second end portion in a first longitudinal direction is enabled and movement in a second, opposite longitudinal direction is inhibited.

In a third aspect of the invention, there is provided a tamper-evident fastening device suitable for use with a wristband, wherein the device comprises: a casing, comprising two separate or hinged parts which are positioned on opposite faces of a divider, and having at least one channel therein having a proximate and a distal portion, said distal portion having a protrusion on one wall of the channel and a recess or step positioned on an opposite wall of the channel; a divider having at least one engagement member adapted for engagement with the channel, said engagement member being adapted to engage the recess or step, and further having a slot therein adapted to engage the protrusion; wherein when the engagement member enters the channel, it is resiliently biased against at least one wall of the proximate part of the channel, and when it traverses the channel to its distal portion, it irreversibly engages with both the step or recess and the protrusion.

According to the above, there is provided an improved fastening device suitable for use with a strap, which makes the strap easy to put on but difficult to remove or loosen without cutting the strap. In a preferred embodiment, the device is suitable for use with a wristband, preferably a fabric wristband. Fabric wristbands are preferably made from a woven or satin fabric material. They are highly secure and are commonly used for festivals and large events. When the fastening device is used with a wristband, it may be tamper evident and hence provide evidence of tampering.

The casing of the device is preferably made from moulded plastic material including, but not limited to, polyesters such as PET, nylon, acrylic such as PAN, polyolefins and the like. Other examples include aramid, polyesters, fluoropolymers, polyethers, polyurethanes and polyphenylene sulfides. Nylon is particularly preferred, specific examples being selected from the group consisting of polyhexamethylene adipamide (nylon 66), poly(butyrolactam) (nylon 4), poly (9-aminonoanoic acid) (nylon 9), poly(enantholactam) (nylon 7), poly(capryllactam) (nylon 8), polycaprolactam (nylon 6), poly(p-phenylene terephthalamide), polyhexamethylene sebacamide (nylon 6,10), polyaminoundecanamide (nylon 11), polydodecanolactam (nylon 12), polyhexamethylene isophthalamide, polyhexamethylene terephthalamide, polycaproamide, poly(nonamethylene azelamide (nylon 9,9), poly(decamethylene azelamide) (nylon 10,9), poly(decamethylene sebacamide) (nylon 10,10), and mixtures thereof. Nylon 6 is particularly preferred.

Preferably, the casing consists of two separate parts which are capable of being connected together by the engagement members on opposing, substantially planar sides of the divider as will be discussed in more detail below.

The casing may have a hinge for connecting the two separate portions, which is capable of folding or bending along an edge such that the casing is capable of closing over the divider, resulting in the divider being disposed within the casing. In this case, the divider is sandwiched between the two halves or two separate portions of the casing.

Alternatively, the casing is provided in two separate halves or portions, which engage with the divider, thereby sandwiching the divider between the two halves. This results in the divider being disposed within the casing.

Preferably the divider has opposite, substantially planar, faces which are brought into face-to-face contact with respective halves or two separate portions of the casing.

In either of the above alternatives, the divider is held or fixed on one half of the casing. This provides a pathway for housing a first end portion of a strap. Preferably, the end portion of the strap is positioned flush with the end of the casing or does not protrude from the casing when the casing halves are closed. For the hinged embodiment, the hinged half of the casing can then be folded over the opposing side of the divider, thereby providing another pathway for housing a second end portion of the strap. The pathways are substantially the same width as the width of the strap. This enables the prevention of the strap being able to move around freely once they are engaged within the pathways of the device. It also enables the strap being reliably and accurately engaged at predetermined positions by one or more of the retaining members.

The same process occurs when separate casing portions are used, except that the second half of the casing is brought into engagement with the divider and the first half of the casing.

Generally speaking, to enable the divider to be fixed to the casing, the divider preferably further comprises at least one engagement member which prevents or restricts the casing from opening once closed. The engagement member is resiliently biased. This means that it is capable of engaging with an opening, providing access to a housing in the casing, by compression of the engagement member. Once the engagement member is positioned within the housing, the resiliently biased portion returns to its resting state, which means that the engagement member cannot be moved back through the opening. Thus, the engagement member is permanently placed within the housing such that an irreversible lock is provided. If a user attempts to open the casing, it would cause breakage of the device, thereby providing evidence of tampering.

The engagement member may be selected from the group consisting of clips, hooks, barbs, V-shaped members and mixtures thereof, preferably hooks or spikes, most preferably hooks. Preferably, the engagement members of the divider have a hook-like profile. The end of the hook is resiliently biased such that when it is pushed into the channel in the casing, it locates behind the step or in the recess, such that it cannot be withdrawn, as will be described in more detail below.

The engagement member may also be substantially T-shaped. The T-shaped engagement member may comprise one or, preferably, two resiliently biased members. The resiliently biased members may be positioned on the same side of the horizontal portion of the T-shaped member. However, they are preferably positioned on opposite sides of the T-shaped member. In this embodiment, in use, the horizontal portion of the T-shaped engagement member initially engages with an opening providing access to a housing in the casing. The opening has the same dimensions as the horizontal portion of the T-shaped member, and the resiliently biased members are compressed until they are positioned within the housing, when they return to their resting state such that they cannot be moved back through the opening in the casing, thereby providing an irreversible lock. If a user attempted to open the casing, it would cause breakage of the device, thereby providing evidence of tampering.

In a preferred embodiment of the invention, the divider comprises six engagement members in total, wherein each planar face comprises three engagement members.

Alternatively, the divider may comprise eight hooks in total, wherein each planar face comprises four engagement members. More preferably, the divider comprises six engagement members in total, wherein each planar face comprises three engagement members.

Preferably, the engagement members provide irreversible engagement with the casing. In other words, the engagement member acts as a lock. By irreversible, it is meant that, in normal use, if an attempt is made to open the device, once it is closed, then the device is broken which provides evidence of tampering. In other words, the engagement members are capable of providing evidence of tampering if the casing is forced open.

When the divider has a planar structure, the one or more engagement members, which prevent the casing from opening once closed, preferably depend from one or more surfaces of the divider. Preferably, said engagement member depends from one or more peripheral edges of the divider. Preferably, said one or more engagement members are upstanding from the plane of the divider, and are preferably substantially perpendicular thereto.

Preferably, the engagement members are resiliently biased such that they clip or lock into at least one housing(s) which are arranged on or in the casing such that they are capable of engaging the engagement means of the divider and thereby prevent or restrict the casing from opening once closed. An opening(s) is provided to give access to the housing(s). The opening has substantially the same dimensions as the engagement member. Preferably, one or more opening forms a channel, into which an engagement means may be pushed, thereby causing the resilient bias to engage the channel. Preferably, the channel is relatively narrow at the open end (the end which the engagement means initially enters, and hereafter referred to as the proximate end of the channel) and relatively wide at the opposite end of the channel (hereafter referred to as the distal end of the channel). Preferably, there is a step or recess in the channel which delineates the proximate end from the distal end of the channel. Once the engagement member has travelled a predetermined distance within the channel, the engagement member passed into the distal part of the channel. This causes a distal portion (a portion remote from the body of the divider) to spring into the distal part of the channel and become engaged (preferably irreversibly engaged) with the distal portion of the channel, such that it cannot be withdrawn therefrom. Preferably, the engagement member passes over the step or recess in the channel, and the engagement member becomes engaged with the distal part of the channel after the step or recess. This means that it cannot be withdrawn from the channel. The channel described in this paragraph can also be referred to as the housing in the casing.

The number of housings or channels on the casing is dependent upon the number of engagement members on the divider. Typically, the number of housings or channels on the casing corresponds to the number of engagement members on the divider, i.e., they are equal.

The engagement members may further comprise a slot configured to engage with a protrusion on the casing. Preferably, the protrusion is positioned within the channel of the casing. Preferably, it is positioned opposite the step or recess (where this embodiment exists).

The slot is positioned on the portion of the engagement member which is substantially perpendicular to the divider. This provides additional locking and renders the device more difficult to open once closed and hence provides additional tamper-proofing. The slot may be square, rectangular, circular, or any other suitable shape. The protrusion on the casing must have a smaller width than the slot so that it can fully engage into the slot.

The casing may further comprise a shield which is capable of covering the engagement member once it is engaged with the casing. This not only provides even further tamper-proofing, but also prevents the engagement member, which may have sharp edges, from catching on items of clothing. The shield is preferably tooth-like.

When the casing is comprised of two separate parts and when the divider has six hooks in total (three on each planar face), each of the two parts of the casing has three openings to engage hooks which are positioned on each planar face of the divider.

Alternatively, the casing has four openings on its upper and lower face to engage hooks which are positioned on each planar face of the divider. Once the casing is closed, lateral movement of a strap is restricted by virtue of the fact that the pathways defined between the divider and the casing have substantially the same width as the strap.

The casing may comprise at least one engagement member to prevent the casing from opening. In this embodiment, the casing also comprises at least one housing or channel arranged to engage the engagement member and thereby prevent the casing from opening.

The engagement member may have a hook like profile (as shown in FIG. 6) and the divider is pushed into the channel (or inserted into an opening which provides access to a housing) on the casing. This causes the end of the hook to become resiliently biased against the channel into which it is pushed, until it approaches the distal end of the channel, where is passes the step or recess. At this point, the end of the hook springs past the step or into the recess, and becomes engaged against it, thereby preventing withdrawal from the channel. If tampering takes place, the situation might occur where the engagement members are pressed such that the hook end is forced back over the step or out of the recess. In this case, the shield portions of the casing prevent or restrict access to the engagement members, thereby reducing the likelihood of successful tampering. However, if one of the shields is removed so as to gain access to the engagement members, a further tamper prevention means may be provided. In this embodiment, when the engagement member has been inserted into the channel, the slot provided on the engagement member has been engaged with the protrusion in the channel (again, see FIG. 6). This means that even if the engagement member is pressed so as to try to force it out of engagement with the step or recess, back along the channel, this is prevented because of the protrusion engaging the slot. Thus, the more one presses the engagement member, the more the protrusion engages with the slot. This renders the device both tamper evident (because removal of the shield is necessary to attempt the opening of the casings), and very difficult to open without destroying the casings and/or the engagement member.

More preferably, the engagement member is T-shaped and works in accordance with the definition outlined in the preceding paragraph. Preferably, the T-shaped member comprises at least two hook-like resiliently biased members, wherein each hook is positioned on opposite sides of the T-shaped member.

Preferably, the divider is planar or at least substantially planar, wherein the divider is substantially planar with respect to the parallel paths which are defined between the divider and the casing. The divider is preferably made from steel, more preferably carbon steel or spring steel.

The first and second retaining members are preferably arranged on opposite sides of the divider and, in a preferred embodiment, the retaining members are an integral part of the divider and are also made from steel, preferably carbon steel or spring steel.

The first and second retaining members are preferably independently in the range of 1 to 8 mm in length, preferably at least 2 mm in length.

The first and second retaining members are preferably independently selected from the group consisting of spears, spikes, barbs or any other shapes capable of retaining, and mixtures thereof. Preferably, the first and second retaining members are barbs or at least resemble barbs. In an even more preferred embodiment, the first and second retaining members have jagged or serrated edges such that they are capable of retaining, preferably wherein said serration comprises at least 2 or 3 barb-like hooks.

Most preferably, the first and second retaining member is a triangular-shaped spike having an apex for piercing a first and second end portion of a strap. Even more preferably, the first and second retaining member is a plurality of triangular-shaped spikes having an apex for piercing a first and second end portion of a strap, preferably three or four triangular-shaped spikes.

The second retaining member is preferably resiliently biased towards a predetermined position which is preferably biased away from the plane of the divider. In this embodiment, the second retaining member may be a length which is the same or at least substantially the same as the height of the pathway defined between the casing and the divider. This provides additional assistance in inhibiting the strap from moving in the second, opposite longitudinal direction, i.e., it is possible to pull or move a strap in the first longitudinal direction over the retaining member but once the retaining member extends through the strap, movement in the second, opposite longitudinal direction is inhibited, preferably substantially prevented.

Alternatively, the second retaining member may have a length which is longer than the height of the pathway defined between the casing and the divider. In this embodiment, the casing comprises a plurality of openings in which the first and second retaining members are engaged when the casing is closed. This encourages a strap to be kept flush within the device such that it cannot be twisted or skewed in any way. The number of openings will correspond to the number of retaining members. For example, preferably, the first and second retaining members are comprised of three or four triangular-shaped spikes. In this case, there will be three or four openings on each portion of the casing.

Preferably the first retaining member depends from and extends perpendicular or at least substantially perpendicular to the plane of the divider. The first retaining member is arranged to extend through the first end portion of a strap. By "substantially perpendicular", we include the meaning that the first retaining member may depend from the divider at an angle of substantially 90°, and also any suitable angle which enables a strap to be retained from longitudinal movement in both directions, for example in the range of from greater than 70° to less than 110°, preferably 80° to 100°, more preferably 85° to 95°.

The second retaining member is arranged to extend through a second end portion of a strap. The second retaining member is arranged to intercept the second end portion of a strap at an acute angle or an angle suitable to enable the strap to move in a first longitudinal direction but retained from movement in a second, opposite direction. For example, the acute angle may be in the range of from less than 70° to greater than 10°, preferably 50° to 20°, more preferably 45° to 30°. This is facilitated by the resiliently biased nature of the second retaining member.

It is possible that the first retaining member is arranged to intercept the first end portion of a strap at an acute angle or an angle suitable to enable the strap to move in one longitudinal direction, but not in the opposite longitudinal direction, as described above in relation to the second retaining member. In this case, the acute angle may be in the same range as the angle disclosed in relation to the second retaining member, i.e., in the range of from less than 70° to greater than 10°, preferably 50° to 20°, more preferably 45° to 30°. In this embodiment, the first retaining member would also be resiliently biased, like the second retaining member.

Preferably, in use, the second end portion of the strap can be pressed against the second retaining member. However, the angle of the retaining member to the plane of the strap does not allow the strap to be pierced by the retaining member until the strap is pulled in the second direction. This is akin to the effect of a fishing hook—the hook does not penetrate the fish until the hook is pulled away from the fish. The resiliently biased nature of the second retaining member also facilitates this effect. In this regard, passing the strap over the second retaining member in the first direction enables the second end portion of a strap to be moved. This is preferably the case even where the strap has already been penetrated by the second retaining means. Thus, further pulling of the strap in the first direction merely facilitates tightening of the strap loop. As the strap passes over the second retaining means in the first direction, the retaining means can be biased towards the plane of the divider, thus making passage of the strap easier.

The fact that the first retaining member is arranged to hold a first end portion of the strap so that longitudinal movement of the first end portion is inhibited, and the second retaining member is arranged to hold a second end portion of the strap such that movement of the second end portion in a first longitudinal direction is enabled and movement in a second, opposite longitudinal direction is inhibited provides many advantages over previous devices that form part of the state of the art.

For example, one such advantage is that identification means (such as a barcode) or tamper evident means may be applied to the first end portion of the strap, i.e., the portion of the strap that is retained such that movement is inhibited in both longitudinal directions. Since the strap is retained from movement by the first retaining member, the identification or tamper evident means will not become partly or wholly hidden by the fastening device when the wristband/strap is made tighter.

Barcoded wristbands offer streamlined admission and an increased level of security and eliminate the chance of counterfeiting and re-entry. Event organisers benefit from this since it allows for real time indication of how many people are scanned in or out of an event at any time. The barcode may be applied using a specialist weave of the fabric or by using a sticker.

The advantage of having two substantially parallel paths for receiving first and second end portions of a strap is that the two end portions of the strap are kept substantially flat and therefore scrunching or folding of the strap is avoided. This enables tidy and efficient application of the strap to the divider, and travel of the strap through the casing. This has the added advantage that when used in combination with a strap comprising identification or tamper evident means, they are not distorted in any way, i.e., the strap is kept flat so that is can be scanned or viewed quickly and efficiently. This means that the time taken to register or scan the identification means, or to view the tamper evident means, is significantly reduced resulting in crowds being controlled more efficiently.

In one particularly preferred embodiment the device comprises radio enabled technology, preferably a radio-frequency identification (RFID) tag. Generally, the device can then be attached to a person using a strap or wristband. The remote wireless device has an integrated circuit (IC), which includes a memory for storing information (e.g., identification data) and a transponder, as well as an antenna for sending and receiving information to and from a reader. The RFID tag can discretely transmit its identification data to the reader, e.g., through broadcasting or in response to an incoming signal, to expedite an identification process.

The radio enabled technology (preferably an RFID tag) used in the device of the present invention may be adapted to discontinue operating (i.e., break and/or stop transmitting signals) when an attempt is made to open the closed device. This provides evidence of tampering as a person will be able to scan the tag and immediately establish whether the tag has been broken or not.

The radio enabled technology (preferably an RFID tag) may be fixed to the device of the present invention by attaching it either to the fabric of the band or to the closure of the band.

The present invention also provides a wristband comprising a strip of material or strap and a fastening device according to the present invention. Preferably, the strip of material or strap is a woven material, for example, a fabric material, most preferably a high tensile material. The width of the strip of material or strap must be sufficient to allow for the application of a unique design and in a preferred embodiment, the strap is in the range of approximately 10 to 20 mm wide. The unique design may incorporate threads of as many colours as possible to inhibit copying. Threads coloured with ultra violet dye may also be incorporated to provide protection against counterfeiting or the strip of material may be impregnated with a material (such as a magnetic material) which allows easy identification thereof.

When both the first and second end portions of the strap are retained by the first and second retaining members, a loop is preferably formed which can be made smaller by movement of the second end portion of the strap in the first longitudinal direction. Preferably, once the casing is closed and both the first and second end portions of the strap are retained, the loop cannot be made larger, since movement of the first end portion of the strap is inhibited.

The second retaining member is preferably arranged such that movement of the strap in the first longitudinal direction causes the second retaining member to pierce the strap, thereby preventing movement in the second longitudinal direction but enabling movement in the first longitudinal direction. When the device is used with a wristband, this means that the loop of the wristband can be made smaller by pulling the second end portion of the strap in the first longitudinal direction. However, since movement in the second, opposite longitudinal direction is inhibited, the wristband cannot be made larger by pulling the second end portion of the strap in the second, opposite longitudinal direction.

To use the wristband, a wearer slides one of his hands through the loop. Using the forefinger and thumb of the same hand, he can then grip the second end portion of the strap and use his other hand in order to slide the device along the strap to tighten the loop around his wrist. At a concert or sporting event, an official will usually put a wristband on each audience member, thereby ensuring that the loop is tight enough and the wristband cannot be slipped over the hand. In order to remove the wristband, it would then be necessary to cut the strap which provides clear evidence that the wristband has been used and thereby prevents it from being re-used.

The structure of the present device also reliably enables a smaller length of strap to be used than is presently the case. In this regard, the first end of the strap may be secured in position in the casing. As no longitudinal movement of this end is allowed once the strap has been engaged by the first retaining member, very little excess strap need to extend from the end of the casing. In fact, the first end of the strap may be enclosed when the casing is closed, and does not protrude therefrom. This embodiment will also help to minimise or avoid tampering therewith.

DETAILED DESCRIPTION

The present invention will now be described with reference to the accompanying drawings. A fastening device according to the present invention is depicted in FIGS. 1 to 4.

Figure 1:
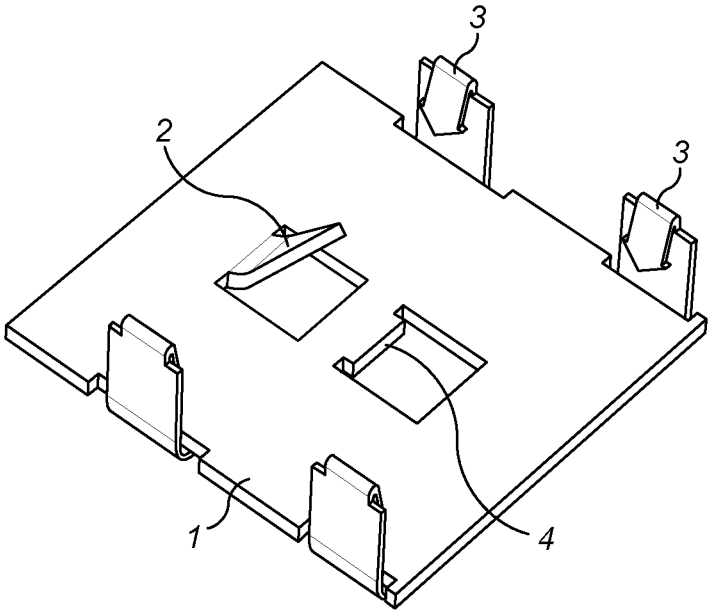
FIG. 1 shows an example of a divider of the device according to the present invention.

An example of a divider of the present invention is shown in FIG. 1. The divider 1 shown is planar and one where the first retaining member 4 and the second retaining member 2 are an integral part of the divider 1. The retaining members are both spikes. Additionally, the divider 1 has a substantially square or rectangular shape. The divider 1 further comprises four engagement members 3 on each planar face of the divider 1. In the embodiment shown, the engagement members 3 are hooks.

Figure 2:
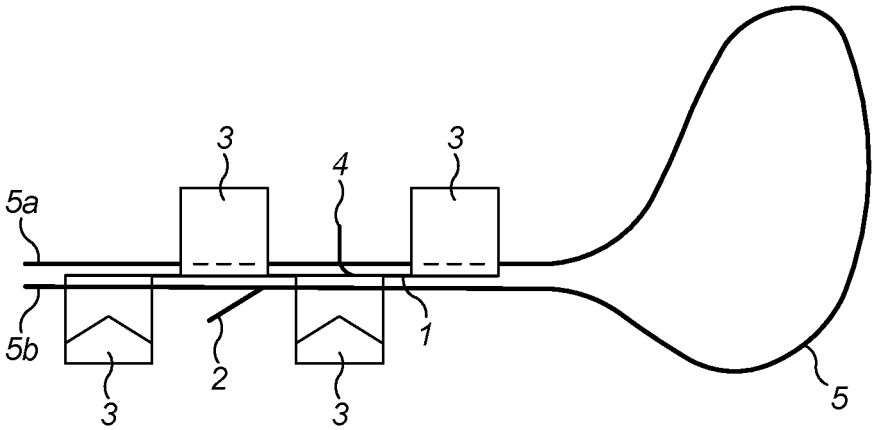
FIG. 2 shows a side view of the divider of FIG. 1 and the position of the first and second retaining members.

FIG. 2 shows a side view of the divider according to FIG. 1. The position of the first retaining member 4 and the second retaining member 2 is depicted in this Figure. For example, it can be seen that the first retaining member 4 is substantially perpendicular to the plane of the divider 1.

The second retaining member 2 is shown at an angle of approximately 45° to the plane of the divider 1. When the second retaining member 2 intersects or pierces a strap 5, the second retaining member 2 is also at an angle of approximately 45° relative to the plane of the strap 5.

In FIG. 2, the first retaining member 4 and second retaining member 2 are shown as offset to each other. In the embodiment shown, this is purely for manufacturing convenience since this enables the retaining members to be cut from the same piece of steel. The retaining members would be punched out of the same piece of steel and folded into the appropriate positions. Of course, it is not essential that the first and second retaining members are offset to each other. Features 5*a* and 5*b* are opposite ends of the strap.

Figure 3A:
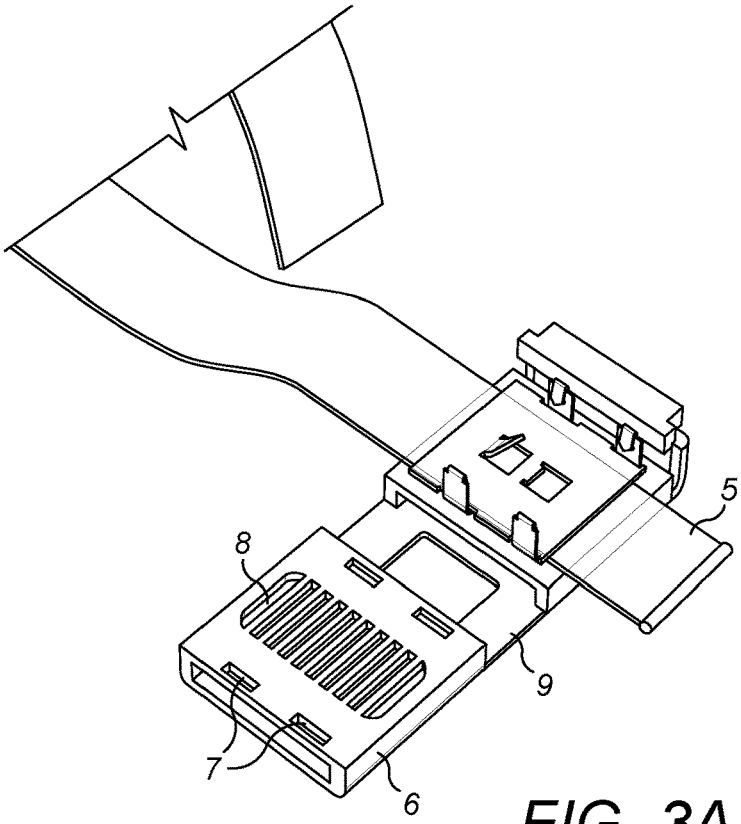
FIG. 3A shows an example of a divider fixed to a casing and the device is shown in an open position, whereby the first end portion of a strap is retained such that movement is inhibited.
Figure 3B:
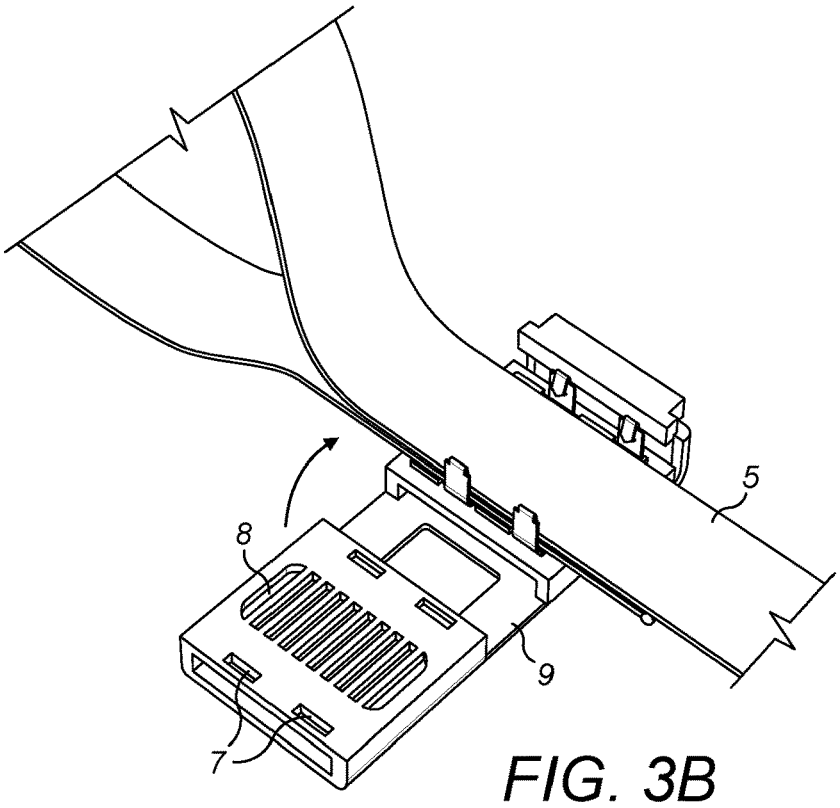
FIG. 3B shows an example of the device in an open position, whereby the first end portion of the strap is retained such that movement is inhibited and the second end portion a strap is overlaid before closing of the device.
Figure 3C:
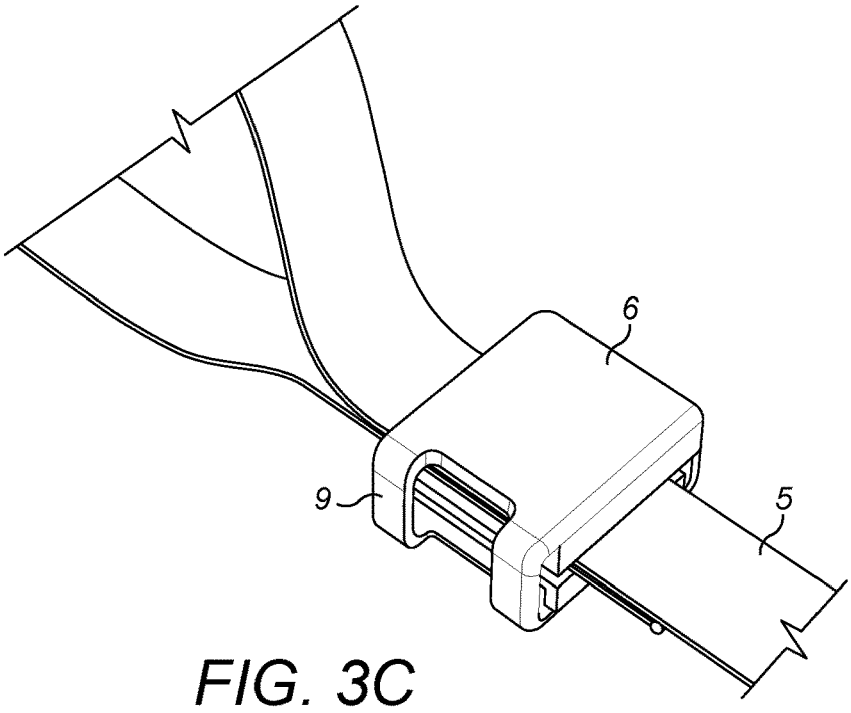
FIG. 3C shows an example of the device according to the present invention in a closed position and in use with a strap.

FIGS. 3A to 3C show an example of a fastening device according to the present invention. FIGS. 3A and 3B show the device in an open position and FIG. 3C shows the device in a closed position ready for use in combination with a strap/wristband.

In this embodiment, the fastening device comprises a plastic moulded casing 6 having a first and second member which are connected via an integrally moulded hinge 9. The first and second member of the casing 6 can be brought into face-to-face registration with each planar face of the divider 1 such that two substantially parallel pathways are defined between the divider 1 and the casing 6, wherein each pathway is defined between the casing 9 and one planar face of the divider 1.

In FIG. 3A, a first end portion of a strap 5 is placed onto the casing 6 and the divider 1 is connected/fixed to the casing 6 by engagement members 3 and the first retaining member 4 inhibits longitudinal movement of the strap. In this particular embodiment, the engagement member 3 are hooks.

The casing 6 comprises four openings 7 on each side of the casing 6, i.e., on each of the first and second members which are connected via the integrally moulded hinge 9. The purpose of these openings 7 is for engaging the engagement members 3 such that the casing 6 is prevented from opening once closed.

Before closing the casing 6 to give the embodiment depicted in FIG. 3C, a second end portion of a strap is laid over the face of the divider 1 such that when the casing 6 is closed by folding it about the integrally moulded hinge 9, the strap forms a loop.

The fastening device in combination with the strap 5 may then be used as a wristband. To use the wristband, a wearer slides one of his hands through the loop. Using the forefinger and thumb of the same hand, he can then grip the second end portion of the strap and use his other hand in order to slide the device along the strap to tighten the loop around his wrist, thereby making the loop smaller. The loop cannot be made larger.

FIGS. 3A and 3B also show an embodiment whereby the casing 6 has a plurality of openings 8 in which the second retaining member 2 is engaged/housed when the casing 6 is closed, thereby preventing the strap 5 from being movable in the second longitudinal direction.

Figure 4:
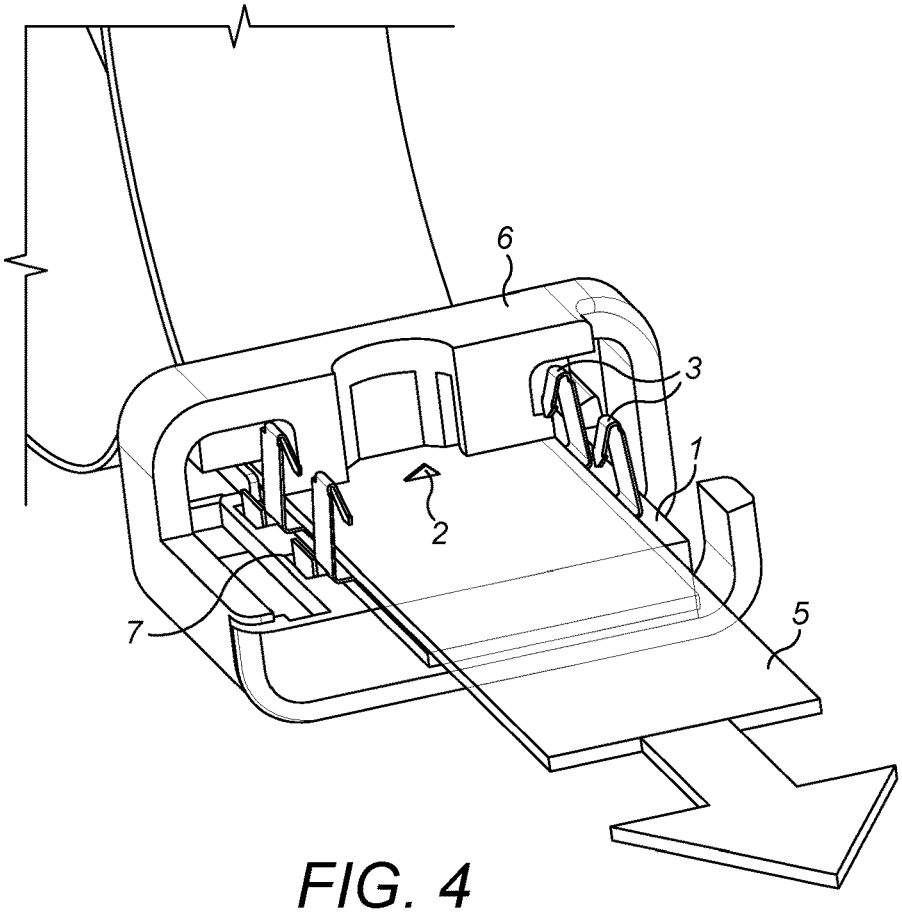
FIG. 4 shows a cross-sectional view of an example of a device of the present invention.

FIG. 4 shows a cross-sectional view of an example of a device according to the present invention.

In this Figure, the second retaining member 2 can be seen extending through or piercing the strap 5 when the device is closed. It is also shown that the engagement members 3 are hooks, of which four are shown on one face of the divider, but as one can imagine, there are also four hooks on the opposite face of the divider 1. The casing 6 comprises openings 7 for engaging/housing the hooks which enable the divider 1 to be fixed to the casing 6. In this embodiment, the hooks are resiliently biased such that the divider 1 clips/locks into the casing 6 and prevents it from opening.

Figure 5:
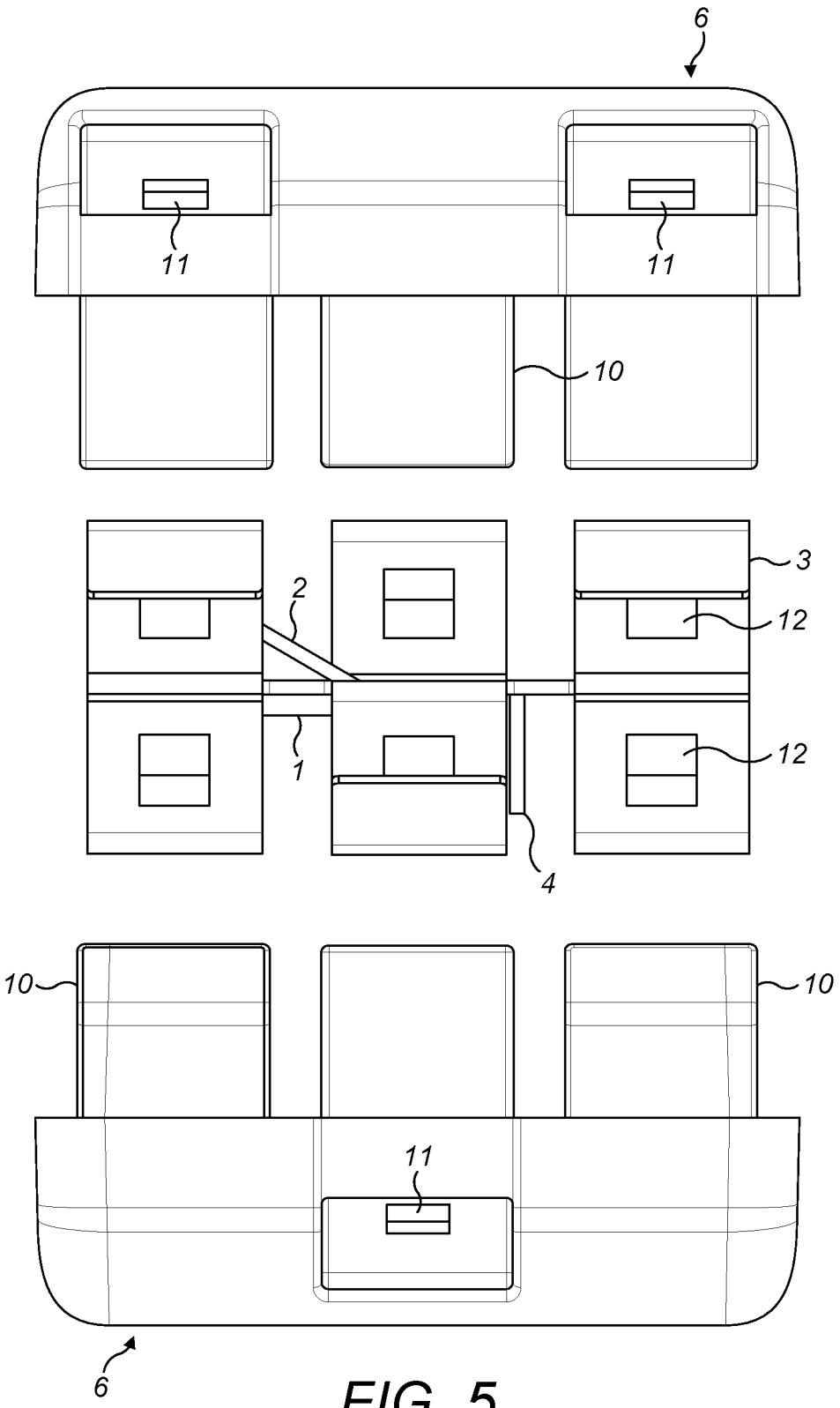
FIG. 5 shows an exploded view of a device according to the present invention in an open position, viewed from the side.
Figure 6:
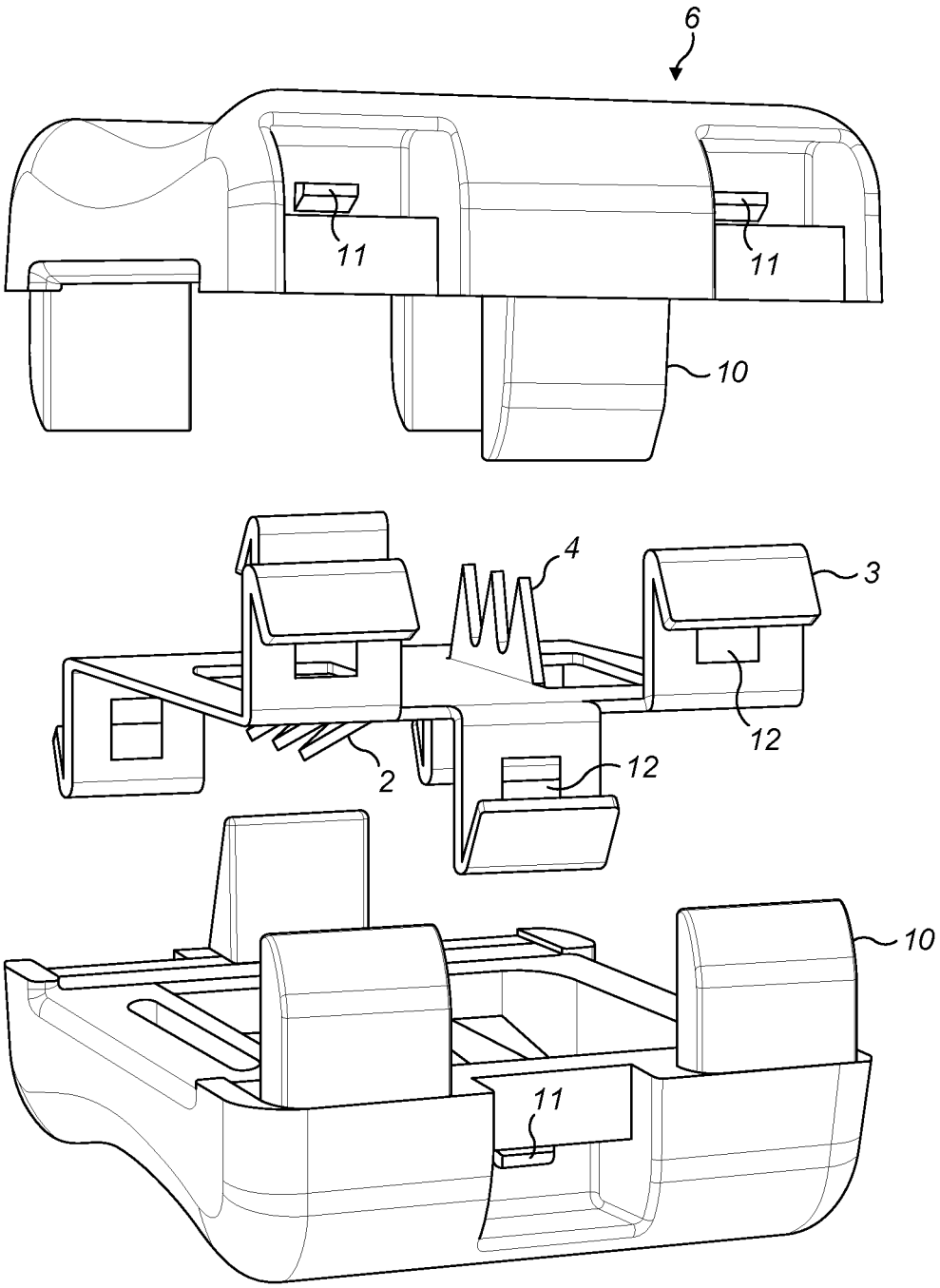
FIG. 6 shows an exploded view of the device of FIG. 5.

A fastening device according to the present invention is also depicted in FIGS. 5 and 6. FIGS. 5 and 6 show an alternative arrangement of the device. This represents a preferred embodiment of the present invention.

In FIG. 5, the casing 6 is depicted as two separate parts wherein the divider 1 is positioned between the two separate parts of the casing 6. The position of the first retaining member 4 and the second retaining member 2 is depicted in this Figure and is the same as that shown in FIG. 2. For example, it can be seen that the first retaining member 4 is substantially perpendicular to the plane of the divider 1 and the second retaining member 2 is positioned at an acute angle of about 45°.

FIGS. 5 and 6 also depicts the locking mechanism of the device which provides for irreversible closing of the device such that if an attempt is made to open the device, once closed, the device is broken which provides evidence of tampering.

The engagement members 3 are shown as hook members. FIG. 6 shows that preferably, there is a total of 6 engagement members 3 on the peripheral edges of the divider 1. The engagement members 3 also each comprise a slot 12 which is depicted as a square hole in the portion of the engagement member 3 which is substantially perpendicular to the divider 1. When the engagement member 3 is inserted into an opening in the casing, the slot engages with a protrusion 11 on the casing. The hook portion of the engagement member passes through the channel in the casing and moves into the recess opposite the protrusion. The hook portion of the engagement member 3 is resiliently biased. The divider is made of metal, preferably steel, more preferably spring steel.

FIGS. 5 and 6 also depict the shields 10 which form part of the casing 6. When the device is brought into the closed position, the shields 10 fully cover the engagement member 3 in situ (i.e., when the sit in the channel, engaged both with the protrusion and the recess).

Figure 7:
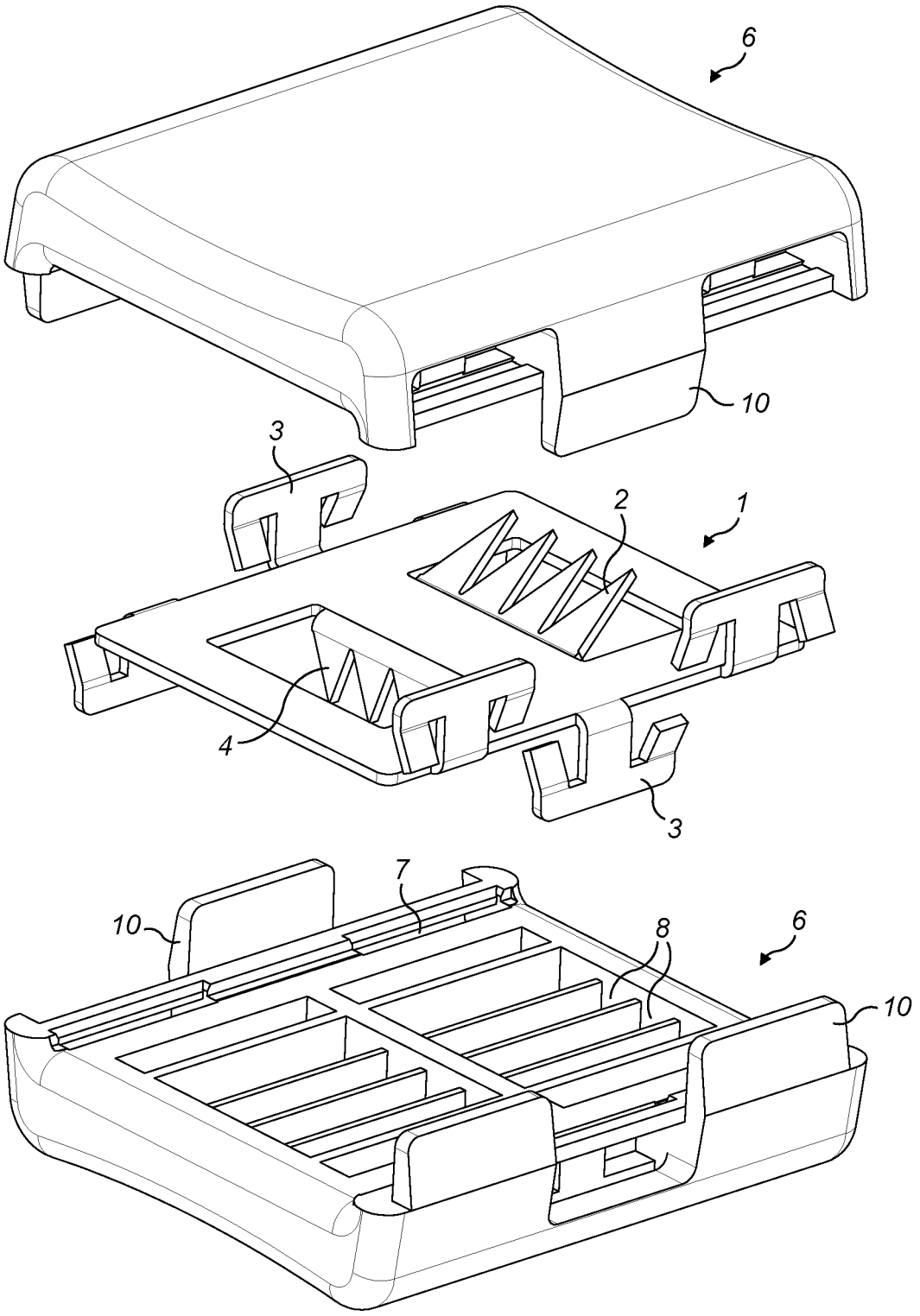
FIG. 7 shows an exploded view of a device according to the present invention, having T-shaped engagement members.

FIG. 7 illustrates a device according to the invention, wherein the engagement members 3 are T-shaped members instead. This represents a particularly preferred embodiment of the present invention. The rest of the device is substantially the same as previously described and, in particular, as depicted in FIGS. 5 and 6.

In FIG. 7, the first and second retaining members 4,2 are a plurality of triangular-shaped spikes, in accordance with a preferred aspect of the invention.

The engagement members 3 in FIG. 7 are substantially T-shaped. The T-shaped engagement member 3 comprises two resiliently biased members, which are positioned on opposite sides of the horizontal portion of the T-shaped member. In use, the horizontal portion of the T-shaped engagement member initially engages with an opening 7 providing access to a housing in the casing. The opening has the same dimensions as the horizontal portion of the T-shaped member, and the resiliently biased members are compressed until they are positioned within the housing, when they return to their resting state such that they cannot be moved back through the opening in the casing, thereby providing an irreversible lock. If a user attempts to open the casing, it would cause breakage of the device, thereby providing evidence of tampering.

A fastening device according to the present invention is a compact device that may be used in combination with a strap to provide a wristband that has improved properties. An additional advantage of the device according to the present invention is that it can be manufactured more easily than devices that form part of the state of the art and the components fit together to provide a small and compact fastening device.

A fastening device has been described particularly in the context of wristbands but it can clearly be used for other purposes, such as ankle bands.

Although one skilled in the art will readily conceive of many alternative embodiments of the invention described above, the present invention includes all such alternatives which fall within the scope of the following claims.

I claim:

1. A tamper-evident fastening device in combination with a wristband having a strap with a first end portion and a second end portion, wherein the combination comprises:

a casing comprising two separate portions; and a divider which defines two substantially parallel paths of the strap of the wristband and is adapted to retain the first and second end portions of the strap, wherein the two separate portions of the casing are positioned on opposite planar surfaces of the divider, and wherein the divider and the two separate portions of the casing are configured such that they are capable of being connected together via an irreversible lock, wherein the divider comprises first and second retaining members, wherein the first retaining member is arranged to hold the first end portion of the strap so that longitudinal movement of the first end portion is inhibited, and wherein the second retaining member is arranged to hold the second end portion of the strap such that movement of the second end portion in a first longitudinal direction is enabled and movement in a second, opposite longitudinal direction opposite to the first longitudinal direction is inhibited.

2. The combination according to claim 1, wherein the first retaining member is arranged to intercept the first end portion of the strap at an acute angle.

3. The combination according to claim 1, wherein the first retaining member depends from and extends substantially perpendicular to the divider.

4. The combination according to claim 1, wherein the second retaining member is arranged to intersect the second end portion of the strap at an acute angle.

5. The combination according to claim 1, wherein the second retaining member is arranged such that movement of the strap in the second longitudinal direction causes the second retaining member to pierce the strap to prevent further movement in the second longitudinal direction.

6. The combination according to claim 1, wherein the second retaining member is resiliently biased towards a predetermined position.

7. The combination according to claim 6, wherein the second retaining member is biased away from the opposite planar surfaces of the divider.

8. The combination according to claim 1, wherein the casing comprises a plurality of openings in which the first and second retaining members are engaged when the divider and the two separate portions of the casing are connected together.

9. The combination according to claim 1, wherein the divider further comprises at least one resiliently biased engagement member to prevent the divider and the two separate portions of the casing from being separated once connected together, thereby, providing the irreversible lock.

10. The combination according to claim 9, wherein the casing further comprises at least one housing arranged to engage the at least one engagement member of the divider and prevent the divider and the two separate portions of the casing from being separated once connected together.

11. The combination according to claim 9, wherein the casing comprises at least one protrusion configured to engage with at least one slot on the at least one engagement member.

12. The combination according to claim 10, wherein the at least one engagement member is at least one resiliently biased hooked member configured to engage with the at least one housing on the casing to provide the irreversible lock.

13. The combination according to claim 12, wherein the at least one resiliently biased hooked member further comprises a slot configured to engage with a protrusion on the casing.

14. The combination according to claim 1, wherein the two separate portions of the casing are connected via a hinge.

15. A fastening device in combination with a wristband having a strap with first and second end portions, said combination comprising:

a casing;

a divider disposed within the casing, wherein two substantially parallel paths for receiving the first and second end portions of the strap of the wristband are defined between the divider and the casing; and first and second retaining members arranged on opposite sides of the divider, wherein the first retaining member is arranged to hold the first end portion of the strap so that longitudinal movement of the first end portion is inhibited, and wherein the second retaining member is arranged to hold the second end portion of the strap such that movement of the second end portion in a first longitudinal direction is enabled and movement in a second, opposite longitudinal direction is inhibited.

16. The combination according to claim 15, wherein the first retaining member depends from and extends substantially perpendicular to the divider.

17. A tamper-evident fastening device suitable for use with a wristband, wherein the device comprises:

a casing, comprising two separate or hinged parts which are positioned on opposite faces of a divider, and having at least one channel therein having a proximate and a distal portion, said distal portion having a protrusion on one wall of the at least one channel and a recess or step positioned in an opposite wall of the at least one channel;

wherein the divider has at least one engagement member adapted for engagement with the at least one channel, said at least one engagement member being adapted to engage the step or recess or step, and further having a slot therein adapted to engage the protrusion;

wherein when the at least one engagement member enters the at least one channel, the at least one engagement member is resiliently biased against at least one wall of the proximate portion of the at least one channel, and when the at least one engagement member traverses the at least one channel to its distal portion, the at least one engagement member irreversibly engages with both the step or recess and the protrusion.

18. The tamper-evident fastening device according to claim 17, wherein the proximate portion of the at least one channel is narrower than the distal portion of the at least one channel.

19. The tamper-evident fastening device according to claim 17, wherein the at least one engagement member has a hook or substantially L-shaped profile.

20. The tamper-evident fastening device according to claim 17, wherein the at least one engagement member is adapted to simultaneously engage both the protrusion with the slot, and the step or recess with a distal portion of the at least one engagement member.

21. The tamper-evident fastening device according to claim 17, wherein the divider comprises a first and a second retaining member.

* * * * *